US007354383B2

(12) United States Patent
Bardha

(10) Patent No.: US 7,354,383 B2
(45) Date of Patent: Apr. 8, 2008

(54) JUMP ROPE WITH PHYSIOLOGICAL MONITOR

(76) Inventor: Ilir Bardha, 3300 Lone Pine Rd., West Bloomfield, MI (US) 48323

( * ) Notice: Subject to any disclaimer, the term of this patent is extended or adjusted under 35 U.S.C. 154(b) by 0 days.

(21) Appl. No.: 11/566,696

(22) Filed: Dec. 5, 2006

(65) Prior Publication Data

US 2007/0129220 A1 Jun. 7, 2007

Related U.S. Application Data

(60) Provisional application No. 60/742,607, filed on Dec. 6, 2005.

(51) Int. Cl.
*A63B 5/20* (2006.01)
*A63B 21/00* (2006.01)

(52) U.S. Cl. ..... 482/82; 482/81; 600/301

(58) Field of Classification Search ..... 482/1–9, 482/81, 82, 900–902; 600/300, 301, 372, 600/500, 508–511, 520, 521
See application file for complete search history.

(56) References Cited

U.S. PATENT DOCUMENTS

| | | | | |
|---|---|---|---|---|
| 3,769,974 | A | 11/1973 | Smart et al. | |
| 3,807,388 | A | 4/1974 | Orr et al. | |
| 4,163,447 | A | 8/1979 | Orr | |
| 5,876,350 | A | 3/1999 | Lo et al. | |
| 6,540,649 | B1 * | 4/2003 | Niedrich | 482/82 |
| 6,584,344 | B2 | 6/2003 | Hannula | |
| 7,229,416 | B2 * | 6/2007 | Chen | 600/500 |
| 2005/0171410 | A1 | 8/2005 | Hjelt et al. | |
| 2005/0288158 | A1 * | 12/2005 | LaTour | 482/81 |

* cited by examiner

*Primary Examiner*—Glenn E. Richman
(74) *Attorney, Agent, or Firm*—Gifford Krass Sprinkle Anderson & Citkowski

(57) ABSTRACT

A jump rope incorporates a sensor in at least one handle which contacts the hand of an exerciser holding the handle. The output signal from the sensor is provided to a microprocessor programmed to analyze the signal and derive a physiological factor of the exerciser such as heart rate and provide a signal of the derived factor to an output device which may be a display or an audio signal generator.

4 Claims, 5 Drawing Sheets

JUMP ROPE WITH PHYSIOLOGICAL MONITOR

CROSS-REFERENCE TO RELATED APPLICATIONS

This application claims priority of U.S. Provisional Patent Application Ser. No. 60/742,607 filed Dec. 6, 2005, which is incorporated herein by reference.

FIELD OF THE INVENTION

This invention relates to exercise devices with built-in health monitors and more particularly to a jump rope with an integral heart monitor.

BACKGROUND OF THE INVENTION

Jumping rope has long been recognized as an excellent aerobic exercise since it simultaneously stresses all the arm and leg muscles, the trunk muscles and increases the heart rate with its attendant cardiovascular advantages. Moreover, it requires minimal apparatus, which is portable and low in cost. The inherent low cost of jump ropes reduces the profitability of manufacturing and marketing them, and thus manufacturers have tended to emphasize much higher priced exercise equipment which is often not as beneficial as jump ropes in terms of achieving exercise goals.

It has previously been proposed to measure various health parameters while jumping rope. For example, Everlast Corporation manufactures a jump rope which includes a calorie counter and a workout timer. Various other jump ropes which include various counters, timers and the like are believed to have been marketed at one time.

A physical parameter obviously of interest to persons jumping rope is their heart rate, since jumping rope elevates the heart rate and it is desirable to exercise at an optimum heart rate given the age and physical size of the exerciser, in order to attain a maximum aerobic improvement without incurring dangerously high heart rates.

SUMMARY OF THE INVENTION

The present invention is accordingly directed toward a jump rope which incorporates a heart rate monitor and may alternatively transmit a heart rate signal and related signals to a remote monitor for display to the person exercising with the jump rope. The jump rope of the present invention measures heart rate by picking up and analyzing EKG signals from the heart muscle, or with a wrist pressure cuff, or a beam of visible or infrared light projected through the skin and processing these signals to determine the heart rate. All of these methods employ sensors associated with one or both of the exerciser's hands which hold the jump rope grips.

In the embodiment in which EKG is sensed, the signals are preferably collected by using the two jump rope handles as electrodes to pick up the EKG signals from the user's two hands. The signals are then provided to a common detection system which analyzes them to generate a heart rate signal. The heart rate signal may be displayed so as to be visible on one handle of the jump rope by means of an LED display or the like, or alternatively may be converted into an electrical signal and wirelessly transmitted to a nearby monitor for ready observation by the exerciser while jumping rope.

The processor is preferably incorporated in one handle of the jump rope which is easily electrically connected to receive the EKG signal from the hand holding that handle. A signal representative of the EKG signal picked up by the other handle may be provided to the processor by a conductor which extends along the jump rope itself, preferably as a central core of the jump rope, or, alternatively, may be wirelessly transmitted to the processor.

In an embodiment which measures pulses to detect heart rate, a sensor embedded in a wrist cuff bears against the inner side of the exerciser's wrist and provides pulse signals to a processor in the adjacent jump rope handle.

In an embodiment of the invention employing a beam of light passed through the skin, preferably a finger of the exerciser which holds the jump rope grip is analyzed.

BRIEF DESCRIPTION OF THE DRAWINGS

Other objects, advantages and applications of the present invention may be made apparent by the following detailed description of several preferred embodiments of the invention. The description makes reference to the accompanying drawings in which.

DETAILED DESCRIPTION OF THE PREFERRED EMBODIMENTS

Figure 1:
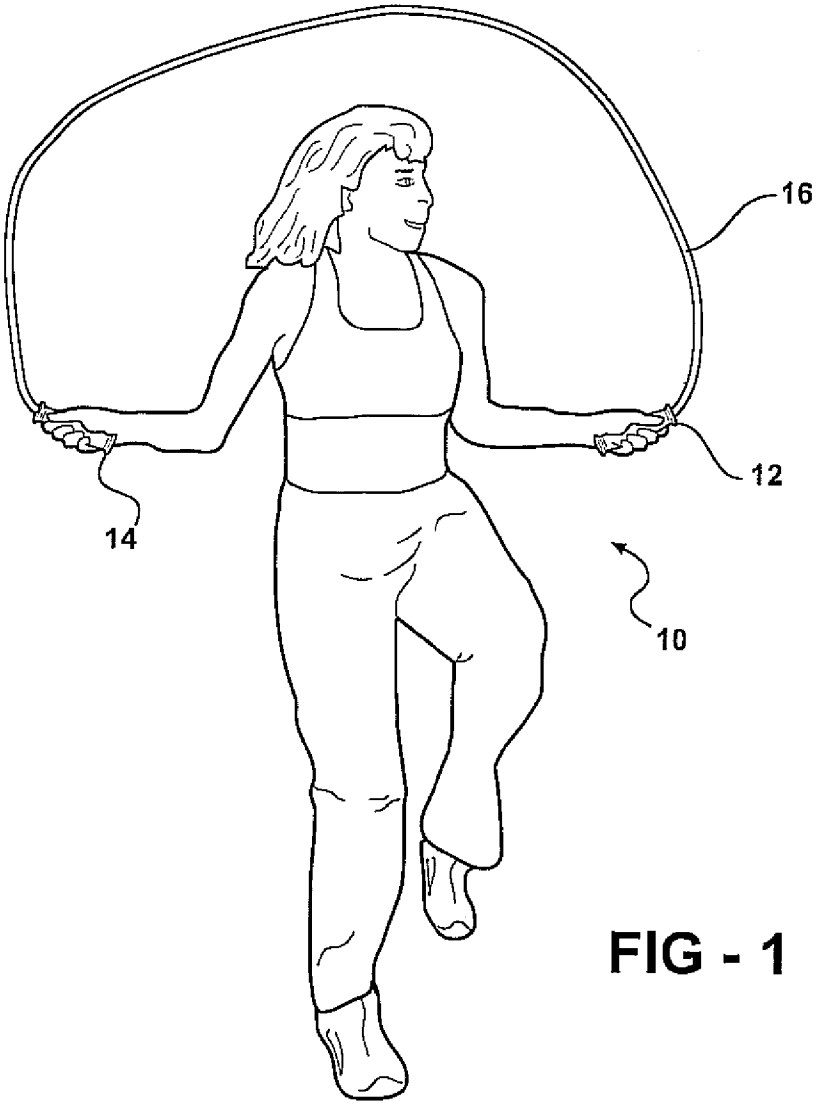
FIG. 1 is a schematic diagram of a person exercising using the heart rate monitoring jump rope of the present invention.

FIG. 1 illustrates an exerciser, generally indicated at 10, grasping the two electrode-handles 12 and 14, formed at the end of a jump rope 16 and using it for exercise in a conventional jump rope manner. Each of the handles is preferably formed of a highly conductive material, preferably copper or the like, or has a sheath of a conductive metal surrounding it, or has at least sections which are engaged by the exerciser's hands during jumping, so as to provide a conductive path between the hands and the electrode-handles. Since the user inherently perspires during use of the jump rope and must intimately grasp the handles 12 and 14, a low-resistance conductive path is established between the handle-electrodes and the exerciser's two hands. This conductive path may be enhanced by placing protuberances on the surface of the handle-electrodes 12 and 14, by roughening the surface or by including clips (not shown) connected to the handles by a flexible conductor (not shown) which may engage the hand or the fingers of the user to enhance the conduction between the electrodes and the hands.

Because of the position of the two arms on opposite sides of the exerciser's body, the EKG potentials at the two hands will include large signal components representing the potentials on opposite sides of the heart. Accordingly, a signal representative of the heartbeat may be detected by comparing the signals picked up by the two handle-electrodes 12 and 14. The two signals are provided to a microprocessor 18 which is preferably embedded in one of the handles. The detected EKG signal from the hand in which the microprocessor 18 is embedded may be directly connected to the microprocessor.

Figure 3:
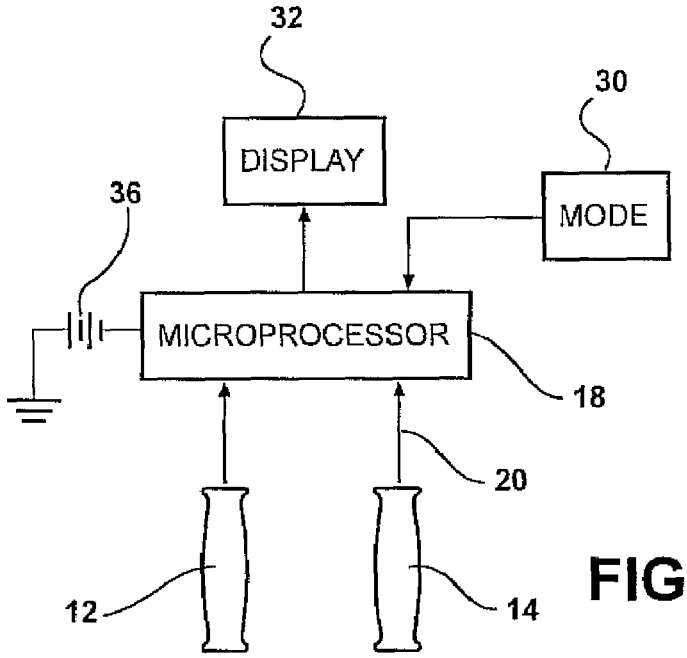
FIG. 3 is a schematic diagram of the electronic circuitry associated with an embodiment of the invention employing a conductive cable formed within the jump rope.
Figure 4:
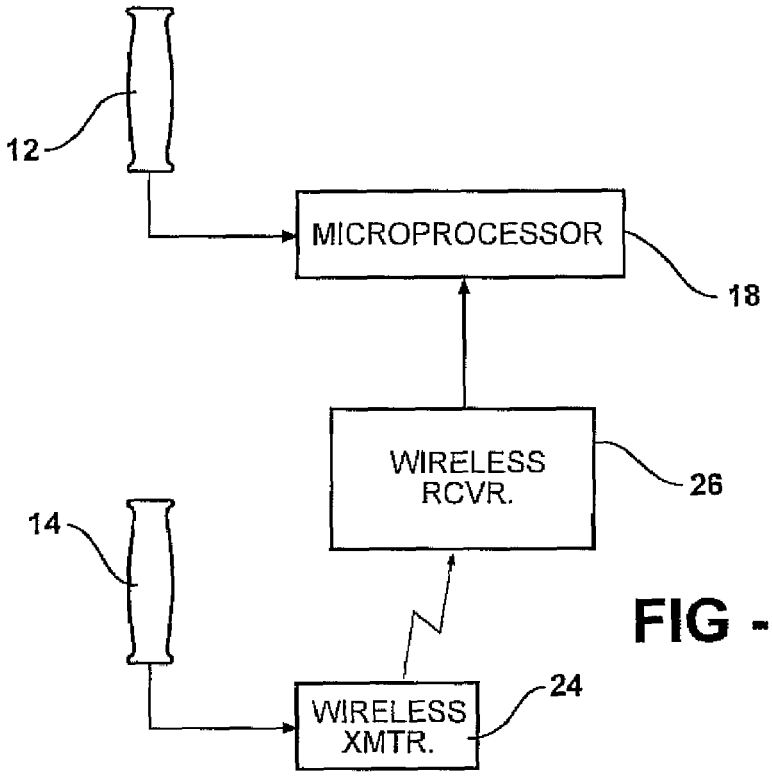
FIG. 4 is a schematic diagram of an alternative embodiment of the invention wherein the signal detected by the electrode comprising one of the jump rope handles is wirelessly transmitted to a processor in the other jump rope handle.

The EKG potential from the opposite handle may be provided to the microprocessor, for comparison with the other EKG signal, in one of two ways. FIG. 3 illustrates a schematic of a system wherein the potential from the second electrode handle is provided to the microprocessor by a flexible conductive cable 20 which is embedded within the jump rope 22 in the manner illustrated in FIG. 2. Alternatively, a wireless transmitter 24 may be incorporated in the handle remote from the microprocessor 18 as illustrated in FIG. 4. In that configuration a wireless receiver 26 receives the signal from the transmitter 24 and provides it to the microprocessor 18 for comparison with the signal from the other handle-electrode 12.

Figure 2:
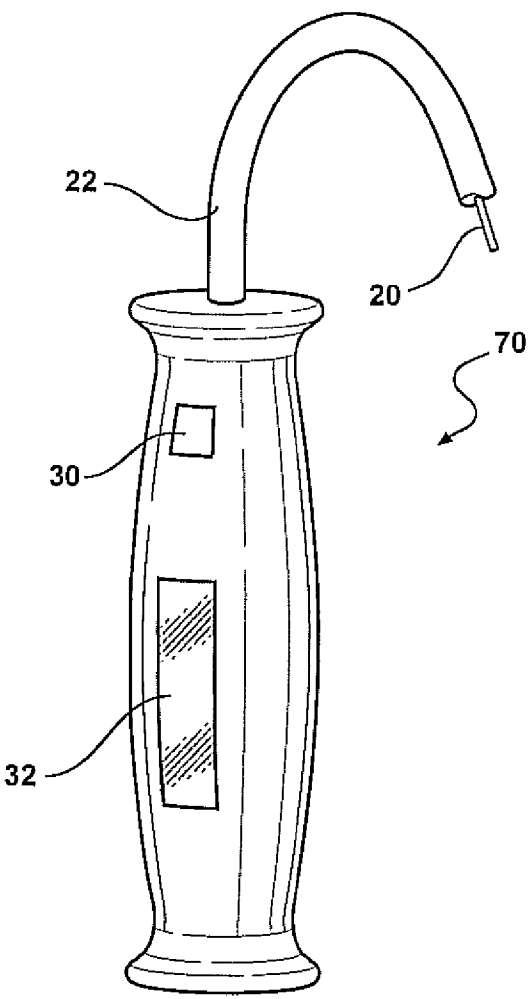
FIG. 2 is a detailed perspective view of one of the handles of the jump rope of the present invention and the attached rope and conductor cable, illustrating the controls and the display of jump-related information, including heart rate, shown on the display.

As illustrated in FIG. 2, the handle 12 which incorporates the microprocessor 18 might also be equipped to display other information related to the jump roping exercise such as the time of exercise, the number of jumps, the calories burned, etc. In this embodiment the handle 12 incorporates a mode control switch 30 which may be actuated by the user to control the information shown on the display 32 fed by the microprocessor. The microprocessor may include a voice synthesizer which generates audio signals incorporating heart rate information or other information selected by the mode switch 30. The audio might include music or a metronome-like skip rate beat. This beat could vary in a random or predictable pattern such as increasing from a low rate to a higher plateau and then decreasing. The plateau could be determined by the measured heartbeat.

As illustrated in FIG. 3, the microprocessor is preferably powered by a battery 36 but could be powered by a suitable generator powered by the rope motion. A capacitor (not shown) might be provided to store the electrical energy generated by the rope motion and provide it to the microprocessor.

The microprocessor may operate in a manner known to those skilled in the art to derive heart rate signals from the two EKG signals. For example, the systems illustrated in U.S. Pat. Nos. 5,876,350 and 6,584,334 or Patent Application Publication 2005/071410 might be used to process and display the heartbeat information.

The conductor 20 embedded within the jump rope 22 might take the form of a multi-strand or braided configuration to aid its flexibility. The outer sheath 22 of the rope may be conventional molded or extruded plastic or elastomer, or fabric or woven jump rope.

The connection between the rope 16 and the handles 12 and 14 preferably allows the rope 16 to rotate in a plane normal to the handles. Also, the connection between one of the handles and the rope 16 should preferably allow the length of the rope to be adjusted for jumpers of different heights. The connections must also allow the conductor 20 within the rope to make continuous electrical connection with the electrodes associated with the handles or the microprocessor 60 circuitry.

Figure 5:
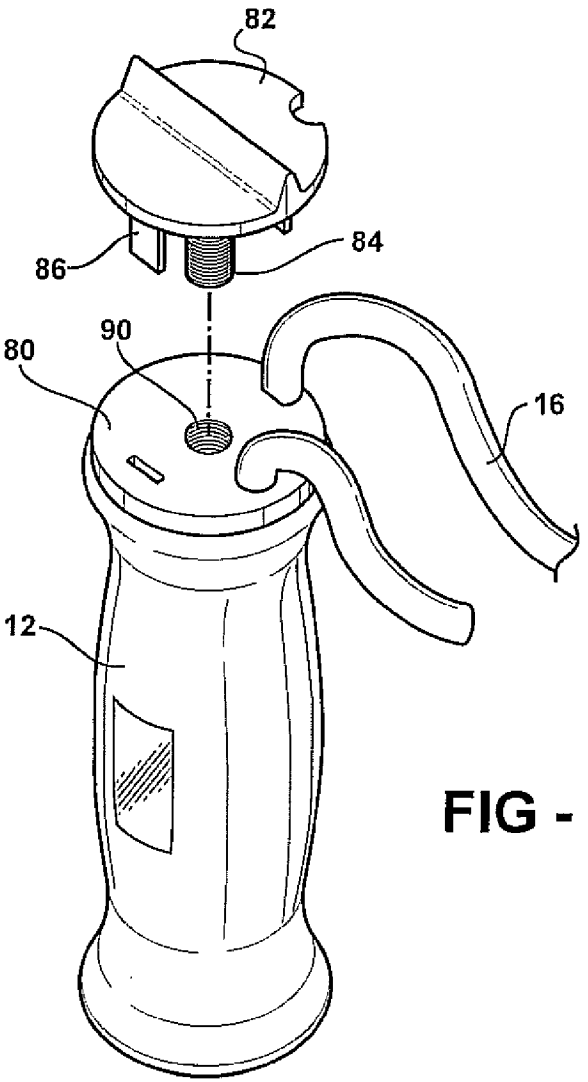
FIG. 5 is a detailed view of a preferred rope-handle connection.

FIG. 5 illustrates a connection that achieves these objects. A handle 12 rotatably supports a cap 80 at one end for rotation about the central axis of the handle. The cap 80 has parts which receive the free end of the rope 20 and allow it to be inserted so that the free end extends outwardly an adjustable distance. The cap has a central threaded hole 90 which receives a screw 84 extending from a lock 82. The lock has extending blades which penetrate the rope 16 and engage the central conductor 20. This conductively couples the conductor 20 to the microprocessor circuit 18.

Figure 6:
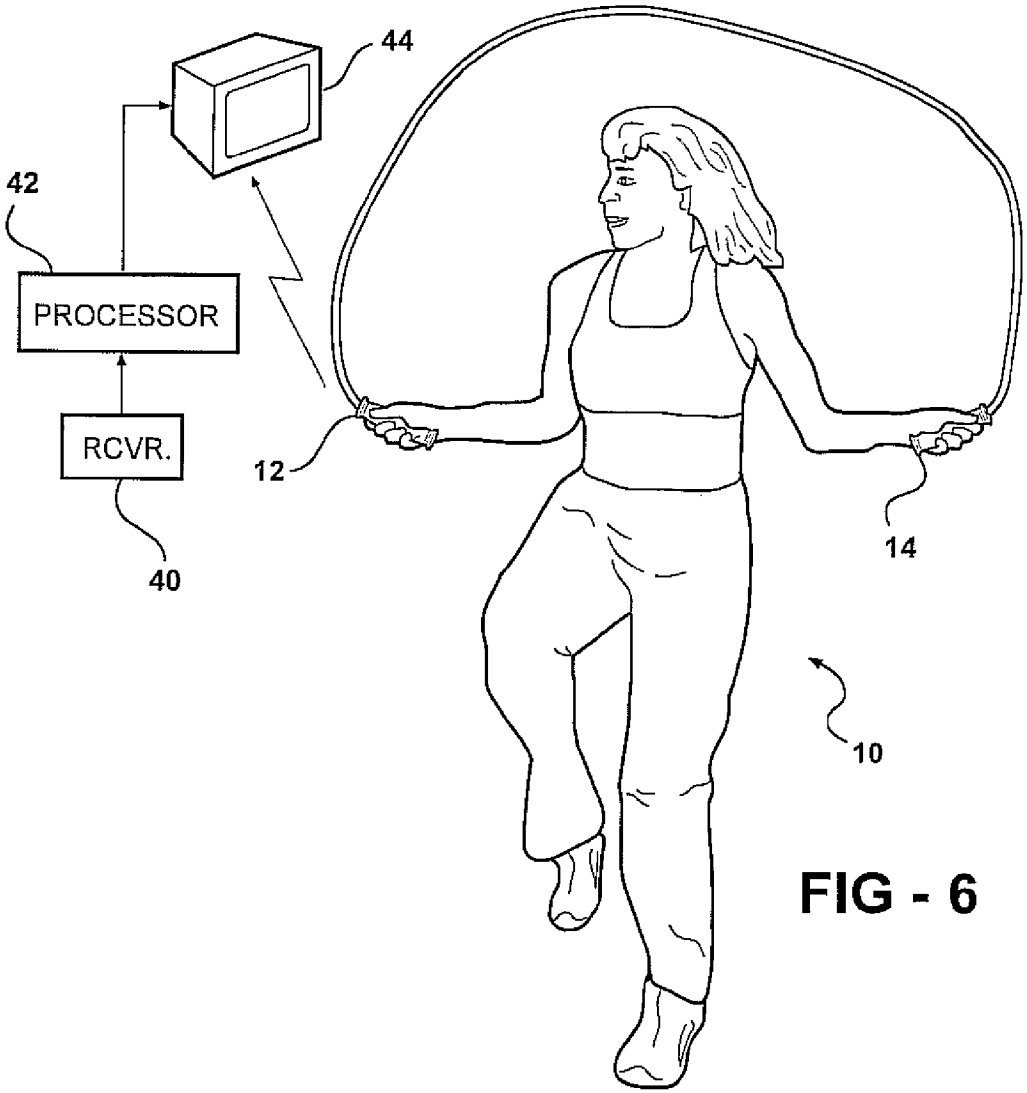
FIG. 6 is a schematic diagram of an embodiment of the invention wherein information picked up by the jump rope, including heart rate information, is wirelessly transmitted to a receiver for display on a monitor.

It is desirable to make the information collected by the system visible to the exerciser 10 without the need to view the handle display 32 or stop the jump roping activity. FIG. 6 illustrates a system in which the information is wirelessly transmitted from the microprocessor 18 contained within the jump rope handle 12, to a remote receiver 40. Received information which might be representative of either the two EKG signals, or the processed heartbeat count as derived from the two EKG signals, along with auxiliary information such as the calorie consumption, jump count, etc., would then be provided to a processor 42 which sends the information to a display 44. The display may be an LCD, LED, plasma screen or CRT. It may be a conventional television set. This might allow the exerciser 10 to watch the conventional television and see a display of the heart rate, continuously or intermittently, in one corner of the display. Techniques like those shown in U.S. Pat. No. 6,574,083 might be used to display the information on a conventional television receiver. In the event that the signal transmitted to the receiver 40 simply constitutes the raw EKG signals, the processing of those signals to derive the heart rate is to be performed in the processor 42.

It should be understood that the heart rate determination is acceptable for exercise purposes even if it has a reasonable margin of error such as a range of 5-10%. It should be easily achieved using a technique like the one disclosed in U.S. Pat. No. 6,584,344 or other alternative arrangements.

Figure 7:
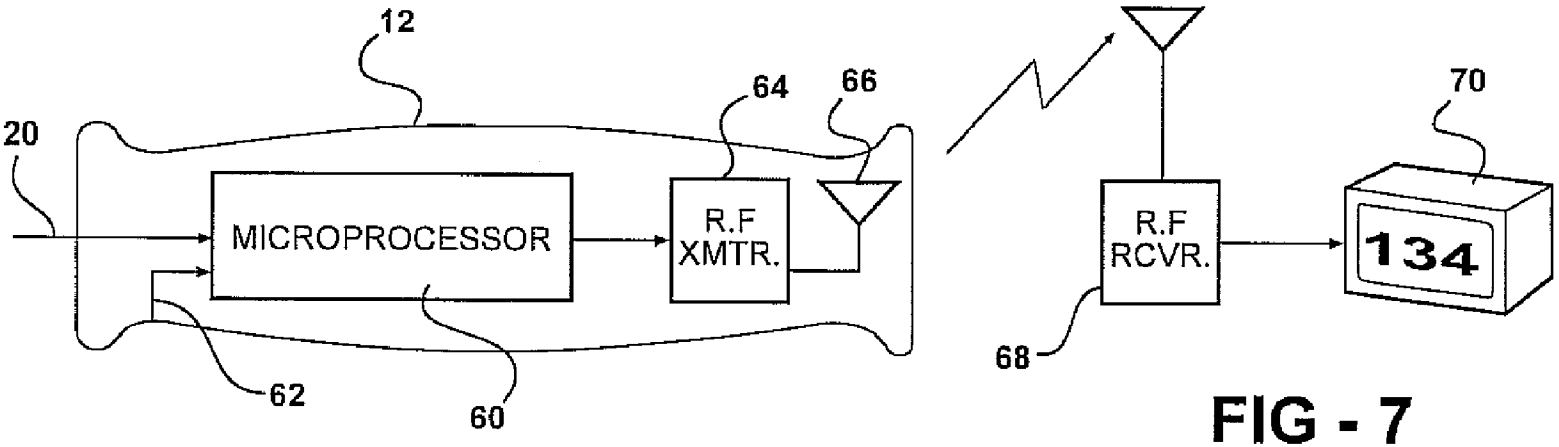
FIG. 7 is a schematic diagram of an alternative remote display system.

FIG. 7 illustrates a variation of the remote display of FIG. 6 in which the heart rate signal is wirelessly transmitted to a standalone display conveniently located for viewing by the exerciser while jumping rope. A microprocessor 60, disposed within the jump rope handle 12, receives one signal on line 62 from the electrode associated with the handle 12 and another signal from conductor 20 connected to the electrode associated with the remote handle 14. The processor 60 is programmed to use the EKG signals to develop a heart rate signal using any available computation algorithm.

The digital signal representative of heartbeat rate (typically a three-byte signal) is provided to an RF transmitter 64 in the handle and the output of the transmitter is provided to an external antenna 66 carried on the handle 12.

The RF signal is picked up by a nearby receiver 68 and provided to a three-character decimal display 70, which might be an LCD or LED display. The display may be refreshed every few seconds.

Figure 8:
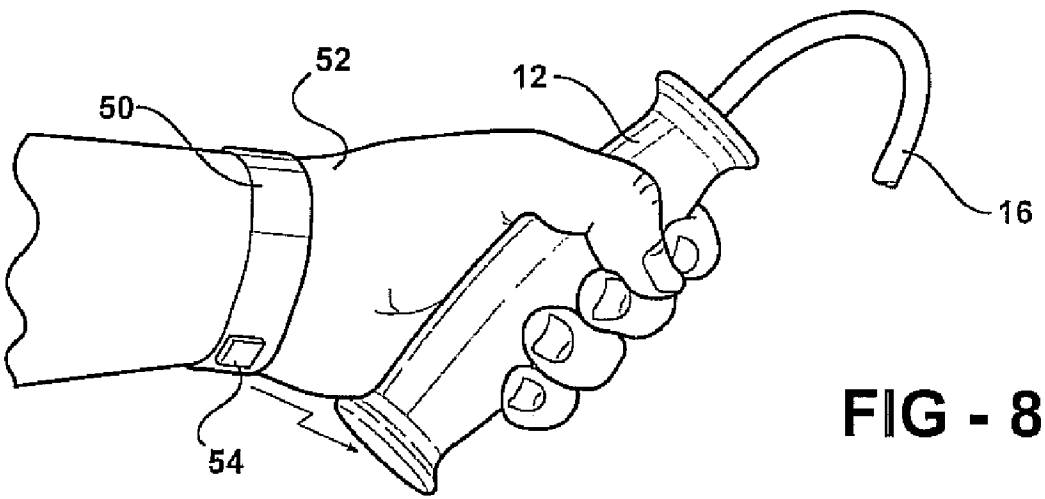
FIG. 8 illustrates a wrist-mounted pulse detector for measuring heart rate.

FIG. 8 illustrates an alternative embodiment of my invention in which the exerciser's pulse rate is used to determine heart rate rather than the measurement and processing of EKG signals.

This embodiment employs an elastic cuff 50 which is placed around a wrist 52 of the exerciser. Velcro fasteners (not shown) may be used to securely retain the cuff 50. The cuff carries a pressure sensor 54, which may be a strain gauge, a magnetostrictive bar or the like, which is positioned to bear against the inner area of the wrist to sense the arterial pulse and generate electrical signals based on the pulse. These signals are carried by a conductor 56 to a processor in the adjacent jump rope handle 12. The resultant heart rate may be displayed on the screen 32 or provided wirelessly to the display 44.

Figure 9:
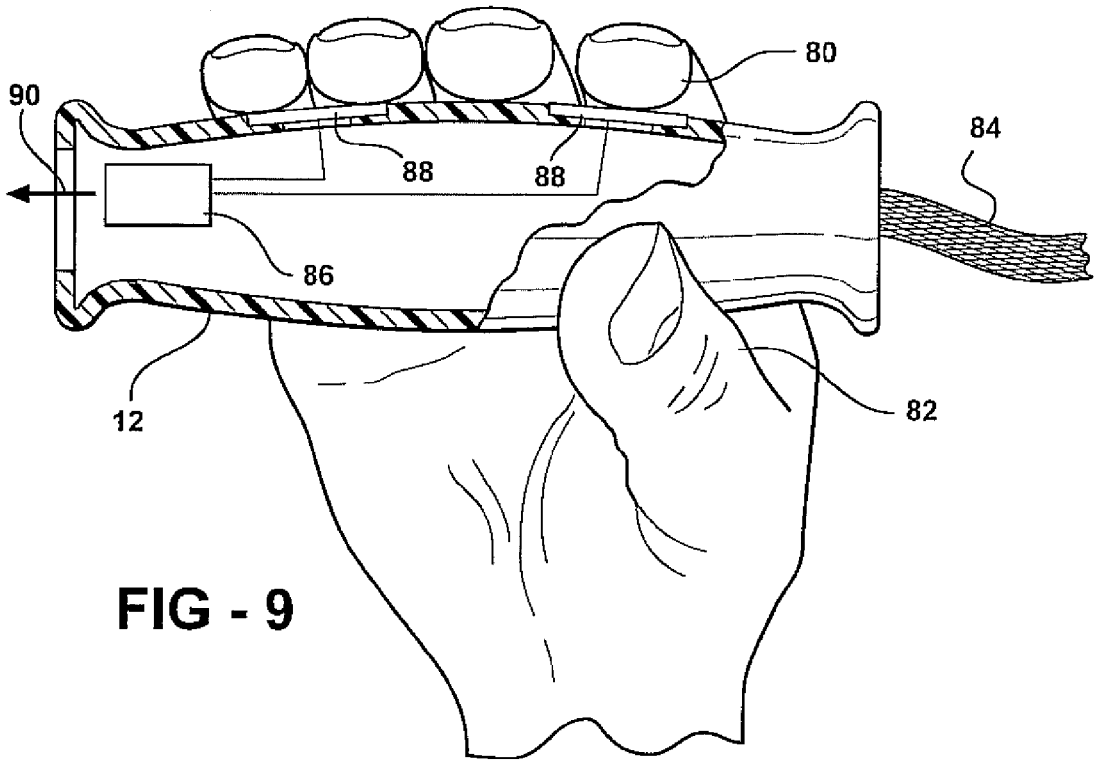
FIG. 9 schematically illustrates an embodiment of the invention which senses pulse rate by passing a light beam through a finger of the user holding one of the jump rope grips.

As an alternative to detecting and analyzing the EKG signals to determine the heart rate, or using a wrist-mounted pulse detector, another embodiment of the invention senses pulse rate by passing a light beam through the skin of the hand of the exerciser holding one of the jump rope grips, and detecting pulsations in the light beam as reflected from an artery. FIG. 9 schematically illustrates this embodiment. This embodiment of the invention projects a beam of light, preferably from an LED, into the hand supporting one of the grips of the jump rope so as to project the light through the skin of the fingers or palm of the hand. The light is preferably of a wavelength which is not reflected by the white skin of the hand but is reflected by the red blood of an artery within the hand. Reflected light is detected by a photo sensor and analyzed to detect the pulse rate. When the blood pressure in an artery changes in response to a heartbeat, the artery enlarges, providing a relatively large reflecting surface and the intensity of the light reflected to the sensor is changed by a corresponding amount. Therefore, the output signal from the sensor is an analog of pulse wave pressure.

FIG. 9 illustrates in cross section a jump rope handle or grip 12 engaged by a human hand, showing the fingers 80 and the thumb 82 of a hand clasping the handle 12 to swing a jump rope 84. A microprocessor 86 and associated auxiliary elements such as a battery are embedded within the grip 12. The microprocessor transmits control signals to an LED 88, which is embedded within the grip 12, so that its emitting surface is flush with the surface of the grip. The LED preferably transmits a light having a wavelength in the range of 6000 to 9000 angstroms in the red or infrared region. The light beam produced penetrates the skin of the fingers 80 supporting the grip and is reflected by arteries disposed within the fingers. These reflect light back to a photo sensor 88 which is embedded within the grip 12 and has its surface flush with the surface of the grip. The resultant signals are provided to the microprocessor 86 for analysis. The microprocessor 86 acts to detect the pulse rate from the reflected signal and provides it on an output line 90 to either a display or a wireless transmitter which provides signals to a display.

The basic detection arrangement may be of the type shown in U.S. Pat. No. 3,769,974 or 3,628,525, or other prior art devices.

Figure 10:
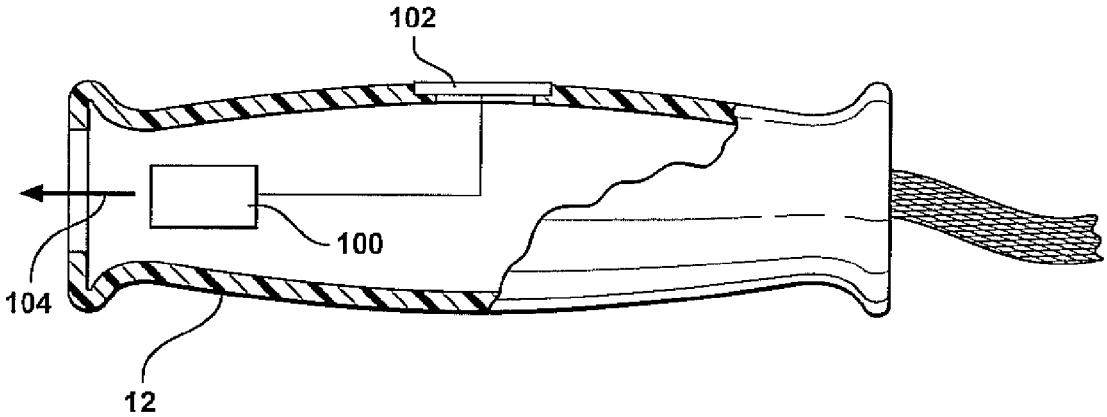
FIG. 10 schematically illustrates an alternative embodiment which employs a pressure-sensitive resistor supported on the rope grip to detect pulse.

Another scheme for detecting the pulse rate in a hand engaging the rope handle or grip is schematically illustrated in FIG. 10. A grip 12 has a microprocessor 100 embedded within it as well as a pressure-sensitive resistor 102 which has its surface flush with the surface of the grip. The pressure-sensitive resistor 102 is connected in an appropriate circuit (not shown) and the output is provided to the microprocessor 100. Pulsations in the pressure applied by the hand on the grip, as a result of arterial pulses, cause variations in the resistance of the unit 102 which are reflected in a signal provided to the microprocessor 100. These signals are analyzed and signals provided on output line 104 to either a display or a wireless transmitter to a display.

In all of these variations of the invention the physiological information is collected by means of the interface between the hand clutching the grip and electronics embedded in the grip itself.

Having thus described my invention, I claim:

1. An exercise apparatus comprising:

an elongated flexible cord;

a pair of handles fixed to opposite ends of the flexible cord so as to allow an exerciser gripping the handles to swing the flexible cord allowing the exerciser to jump rope;

electrodes disposed in each of the handles adapted to contact the exerciser's hands as the exerciser jumps rope;

a microprocessor disposed in one of said handles and in electrical connection with the electrode disposed in that handle and connected to receive the output of the electrode in the other handle;

a program for the microprocessor adapted to process the signals received by the microprocessor from the two electrodes and to generate a signal proportional to the exerciser's heart rate; and an output device for communicating the processed heart rate signal to the exerciser.

2. The exercise device of claim 1 wherein the connection between the sensor and the other handle and the microprocessor is through the conductor disposed in the flexible cord.

3. The exercise device of claim 1 wherein the connection between the electrode disposed in the other handle and the microprocessor comprises a wireless link.

4. The exercise device of claim 1 wherein the microprocessor is associated with a display, remote from the jump rope, and wireless links connect the two electrodes to the microprocessor.

* * * * *